US009206800B2

(12) United States Patent
Rago

(10) Patent No.: US 9,206,800 B2
(45) Date of Patent: Dec. 8, 2015

(54) MULTIPLE STAGE PASSIVE VARIABLE DISPLACEMENT VANE PUMP

(71) Applicant: Magna Powertrain Inc., Concord (CA)

(72) Inventor: Guiseppe Rago, Mississauga (CA)

(73) Assignee: Magna Powertrain Inc., Concord (CA)

( * ) Notice: Subject to any disclaimer, the term of this patent is extended or adjusted under 35 U.S.C. 154(b) by 10 days.

(21) Appl. No.: 13/896,573

(22) Filed: May 17, 2013

(65) Prior Publication Data

US 2013/0309113 A1 Nov. 21, 2013

Related U.S. Application Data

(60) Provisional application No. 61/648,760, filed on May 18, 2012.

(51) Int. Cl.

| | |
|---|---|
| ***F03C 2/00*** | (2006.01) |
| ***F04C 2/00*** | (2006.01) |
| ***F04C 14/18*** | (2006.01) |
| ***F04C 2/04*** | (2006.01) |
| ***F04C 14/22*** | (2006.01) |
| ***F04C 2/344*** | (2006.01) |

(52) U.S. Cl.
CPC ..... *F04C 2/04* (2013.01); *F04C 2/3442* (2013.01); *F04C 14/223* (2013.01); *F04C 14/226* (2013.01)

(58) Field of Classification Search
USPC ..... 418/24–27, 30, 259, 270; 417/220
See application file for complete search history.

(56) References Cited

U.S. PATENT DOCUMENTS

| | | | | |
|---|---|---|---|---|
| 4,538,974 | A | 9/1985 | Stich et al. | |
| 5,141,418 | A | 8/1992 | Ohtaki et al. | |
| 7,794,217 | B2 * | 9/2010 | Williamson et al. | 418/26 |
| 8,011,908 | B2 | 9/2011 | Williamson et al. | |
| 2001/0031204 | A1 * | 10/2001 | Oba et al. | 417/220 |
| 2007/0224067 | A1 * | 9/2007 | Arnold et al. | 418/26 |
| 2008/0247894 | A1 * | 10/2008 | Lutoslawski et al. | 418/27 |
| 2008/0308062 | A1 * | 12/2008 | Morita et al. | 417/220 |
| 2009/0101092 | A1 | 4/2009 | Ichinosawa et al. | |
| 2009/0285707 | A1 * | 11/2009 | Williamson et al. | 418/27 |
| 2010/0086424 | A1 * | 4/2010 | Krug et al. | 418/30 |
| 2010/0282204 | A1 | 11/2010 | Zwickler et al. | |

FOREIGN PATENT DOCUMENTS

| | | |
|---|---|---|
| WO | WO2008/003169 | 1/2008 |

* cited by examiner

*Primary Examiner* — Theresa Trieu
(74) *Attorney, Agent, or Firm* — Harness, Dickey & Pierce, P.L.C.

(57) ABSTRACT

The present invention is a multiple stage variable displacement vane pump comprising a pressure regulating spring guide. A first spring and a second spring may be controlled by said pressure regulating spring guide. The present invention does not require a solenoid or electronic control. Control of flow and speed is achieved through operable of the pressure regulating spring guide that causes the first spring and second spring to be operable in relation to one another, but for the first spring and the second spring to be operable independently of each other. The springs may be positioned to be inline in relation to each other. Rotation of a slide and pressure exerted thereby upon the pressure regulating spring guide may create a first spring regulation stage and a second spring regulation stage.

15 Claims, 13 Drawing Sheets

MULTIPLE STAGE PASSIVE VARIABLE DISPLACEMENT VANE PUMP

CROSS-REFERENCE TO RELATED APPLICATIONS

This application claims the benefit of U.S. Provisional Application No. 61/648,760, filed on May 18, 2012. The entire disclosure of the above application is incorporated herein by reference.

FIELD

This invention relates in general to the field of passive variable displacement vane pumps and more particularly to a variable displacement pump incorporating multiple pump stages without use of a solenoid.

BACKGROUND

Many industrial and automotive devices require a pressurized supply of incompressible fluid such as lubricating oil to operate. Pumps, typically used to supply these fluids, can either be of variable or constant displacement designs.

With a constant displacement pump, the pump outputs a substantially fixed volume of working fluid for each revolution of the pump. To obtain a desired volume and/or pressure of the working fluid the pump must either be operated a given speed, independent of the speed of the automotive engine or other device supplied by the pump, or a pressure relief valve must be provided to redirect surplus flow, when the pump is operated above the speed required for the desired flow, to the low pressure side of the pump or to a working fluid reservoir.

With a variable displacement pump, the volumetric displacement of the pump can be altered, to vary the volume of fluid output by the pump per revolution of the pump, such that a desired volume of working fluid can be provided substantially independently of the operating speed of the pump.

Variable displacement pumps are typically preferred over constant displacement pumps with relief valves in that the variable displacement pumps offer a significant improvement in energy efficiency, and can respond to changes in operating conditions more quickly than pressure relief valves in constant displacement pumps.

A typical variable displacement pump is a single stage pump that includes a single spring. Prior art approaches to creating a multiple stage variable displacement pump have involved the addition of a solenoid that is controlled by the electrical system of the engine. Such prior art pumps are costly due to the requirement for electrical input to operate the solenoid incorporated in the pump.

U.S. Pat. No. 4,538,974 issued to Glyco Antriebstechnik GmbH, discloses a pump that has a stator formed with intake and output ports connected to the lubricating system of a internal combustion engine of an automotive vehicle for flow therethrough. The disclosed pump is directed to providing meaningful lubricant flow even when the lubricant is very viscous, normally when cold.

U.S. Patent Application Publication No. 2009-0101092 (corresponding to Japanese Patent Application Publication No. 2009-97424) discloses a conventional variable displacement pump including a first spring arranged to constantly apply an urging force to a cam ring, and a second spring arranged to provide an urging force in a direction opposite to the urging force of the first spring when the cam ring is moved by a predetermined distance or more. In this conventional variable displacement pump, an eccentric state of the cam ring is varied in two stages (steps) by the relative urging forces of the springs, so that the discharge flow rate characteristic is varied in the two stages.

U.S. Pat. No. 8,011,908 issued to Magna Powertrain Inc. discloses a variable capacity vane pump having a control ring that is moveable to alter the capacity of the pump. A primary spring acts between a control ring and the casing to bias the control ring towards a position of maximum volumetric capacity and a secondary return spring is mounted in the casing and is configured to engage the control ring after the control ring has moved a predetermined amount. This patent discloses springs that are not positioned to be inline and are not controlled by a pressure regulating spring guide.

SUMMARY

In one aspect, the present disclosure relates to a multiple stage variable displacement vane pump comprising: a rotor including a plurality of vanes slidably extending radially from the rotor; a pump housing defining a pump inlet, a pump outlet and a rotor chamber receiving the rotor and including an inlet port in communication with the pump inlet and through which working fluid is introduced to the rotor and an outlet port through which working fluid exits the rotor to the pump outlet, the outlet port being connected to the pump outlet via a passage; a cam ring encircling the rotor, the ends of the vanes of the rotor engaging the inner surface of the cam ring to form variable volume pump chambers between adjacent vanes, the rotor and the cam ring, the cam ring being pivotable within the rotor chamber about a pivot point to alter the eccentricity of the cam ring with respect to the rotor to change the displacement of the pump, said cam ring having a slider incorporated therein; a pressure regulating spring guide operable to control two or more springs, said two or more springs being positioned inline to each other and in proximity to the pressure regulating spring guide, said pressure regulating guide being operable through contact with the slider; and a regulating chamber receiving working fluid from the pump outlet, the working fluid applying a regulating force to the cam ring.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of description and should not be regarded as limiting.

DRAWINGS

The invention will be better understood and objects of the invention will become apparent when consideration is given to the following detailed description thereof. Such description makes reference to the annexed drawings wherein.

Figure 5A:
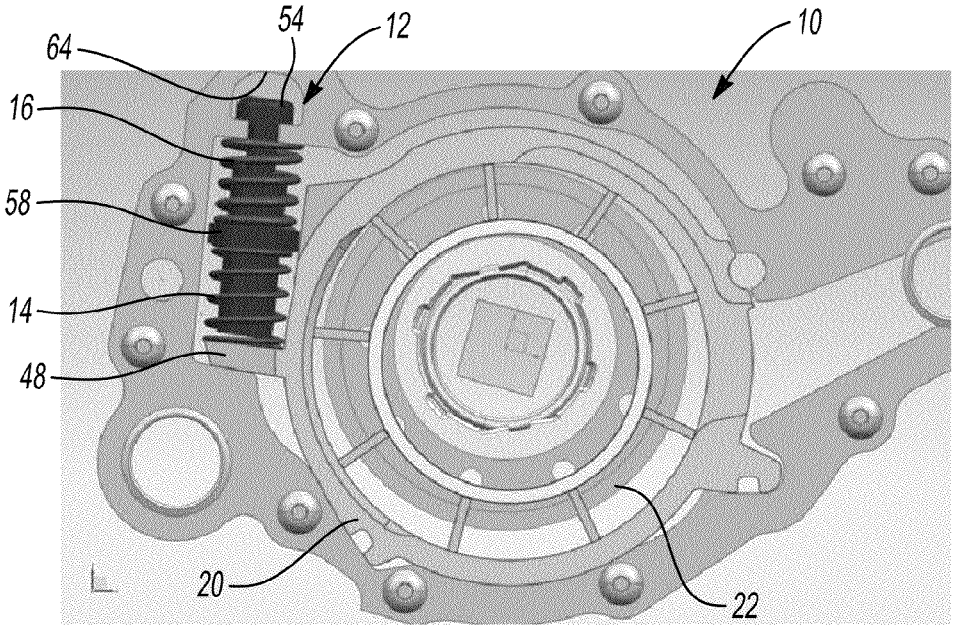

FIG. 5*a* shows a front view of a pump of the present invention in a low pressure environment prior to a first point of regulation.

Figure 5B:
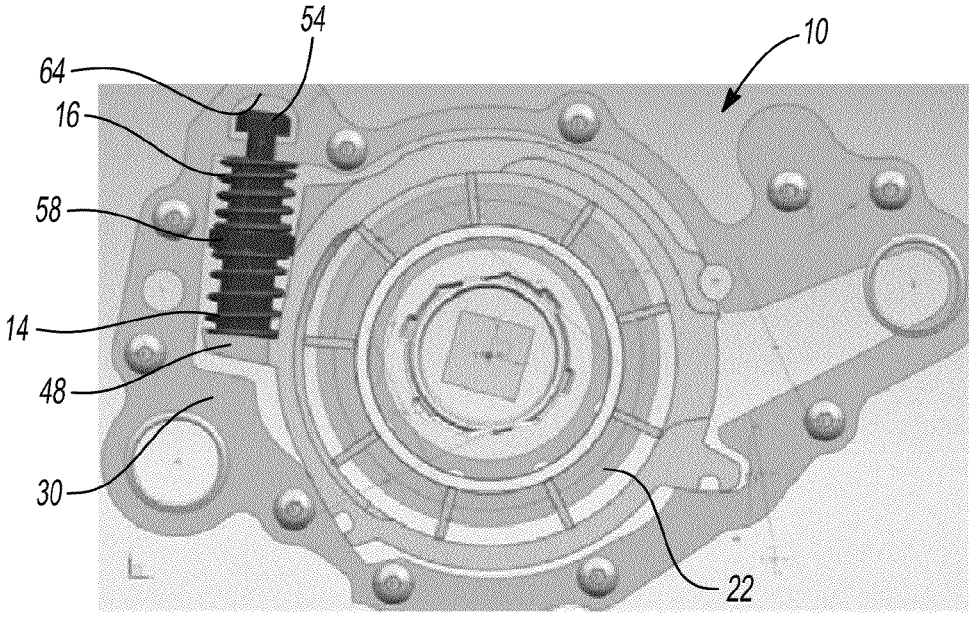

FIG. 5*b* shows a front view of a pump of the present invention in between a first point of regulation and a second point of regulation.

Figure 5C:
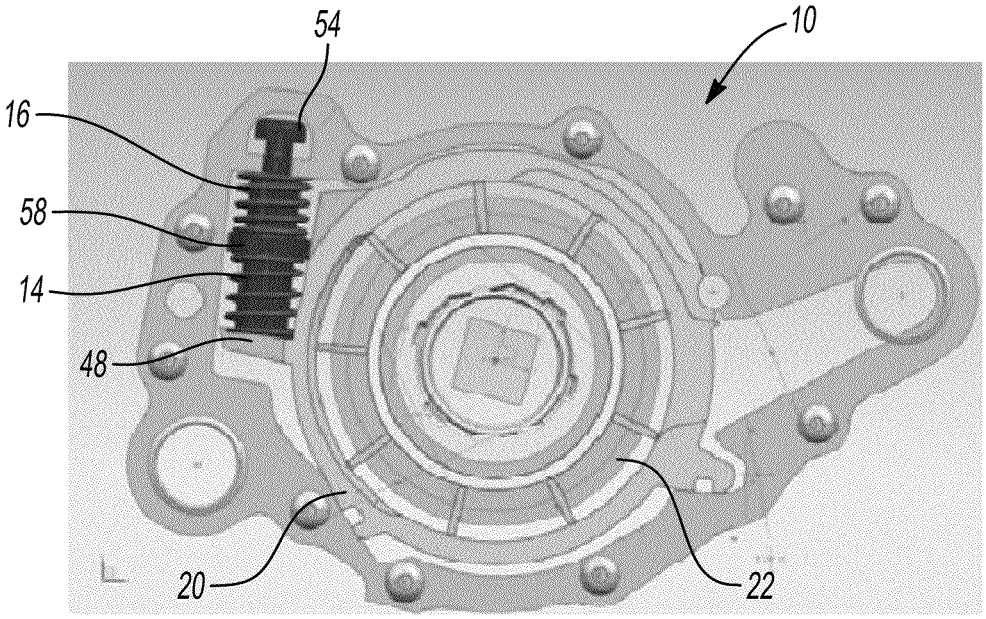

FIG. 5*c* shows a front view of a pump of the present invention after a second point of regulation.

Figure 6A:
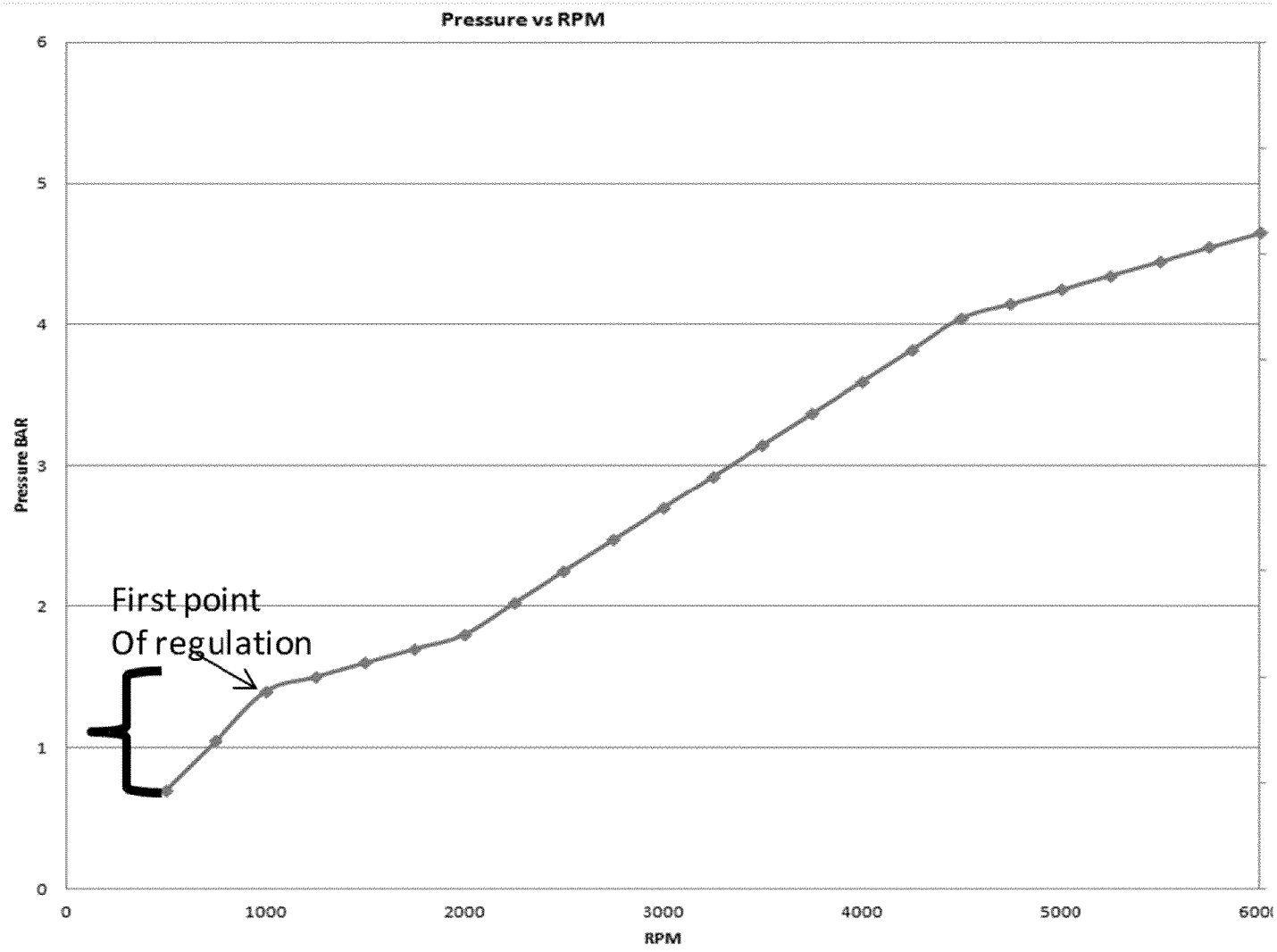

FIG. 6*a* shows a table of an example of a pump of the present invention highlighting a stage prior to a first point of regulation.

Figure 6B:
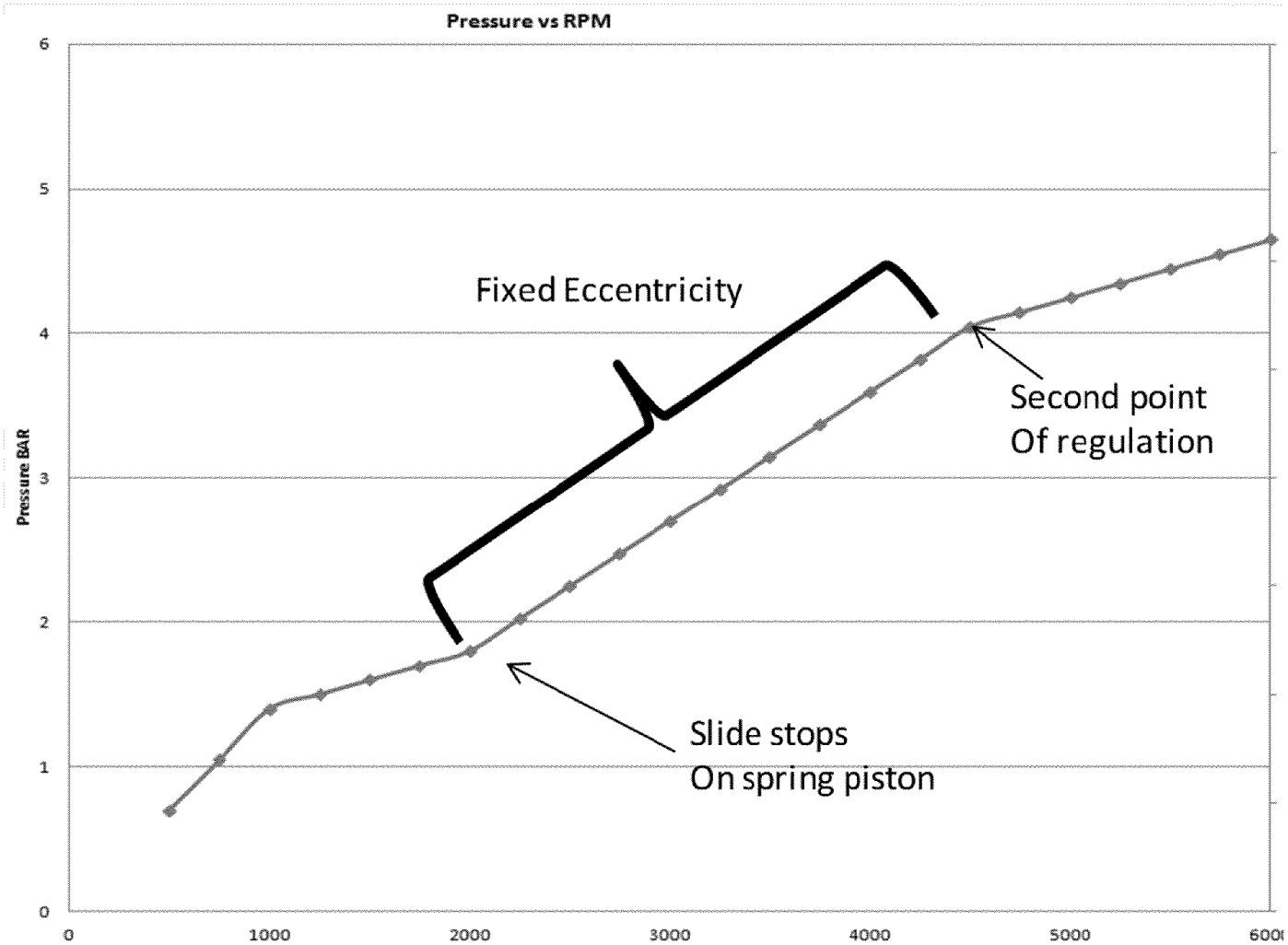

FIG. 6*b* shows a table of an example of a pump of the present invention highlighting a stage between a first point of regulation and a second point of regulation.

Figure 6C:
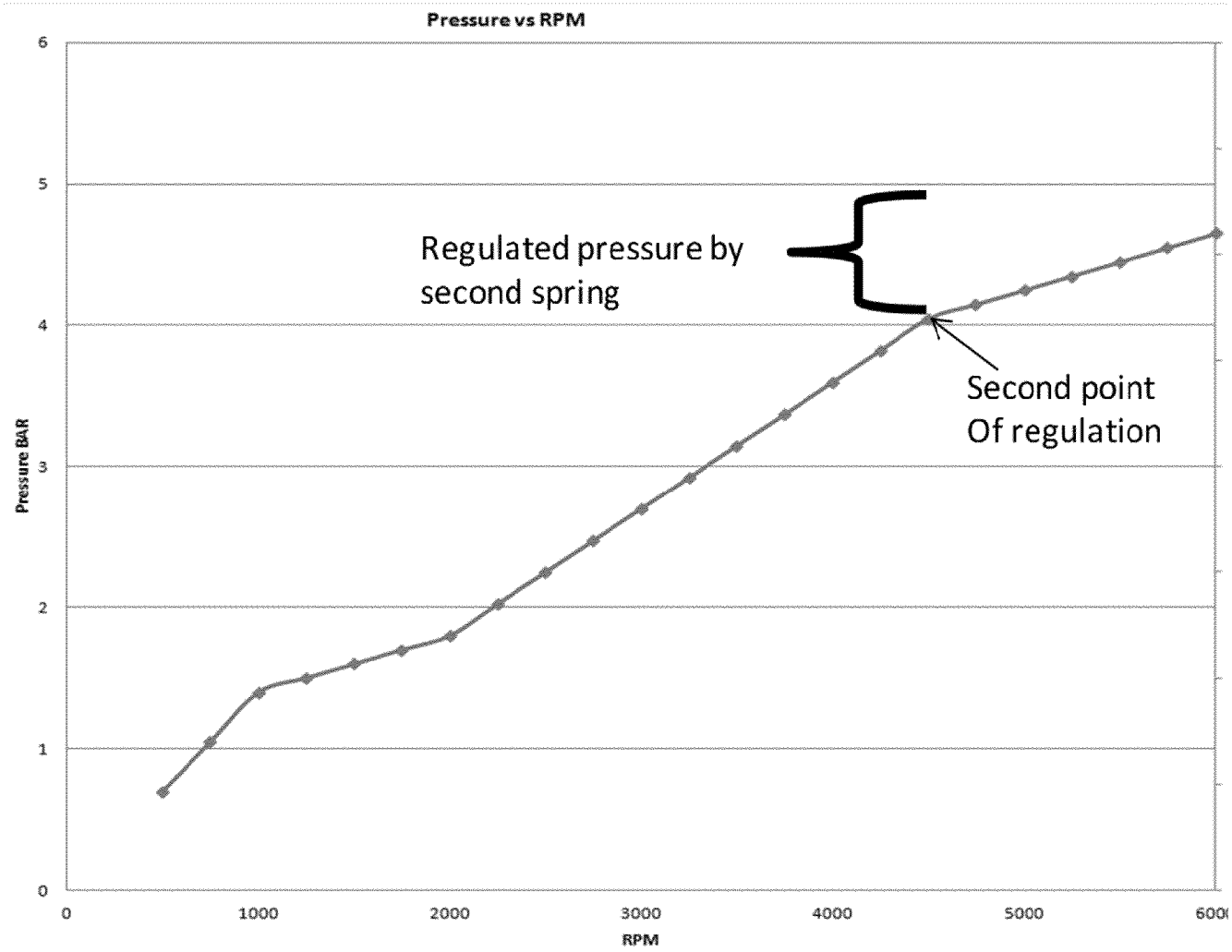

FIG. 6*c* shows a table of an example of a pump of the present invention highlighting a stage after a second point of regulation.

Figure 7:
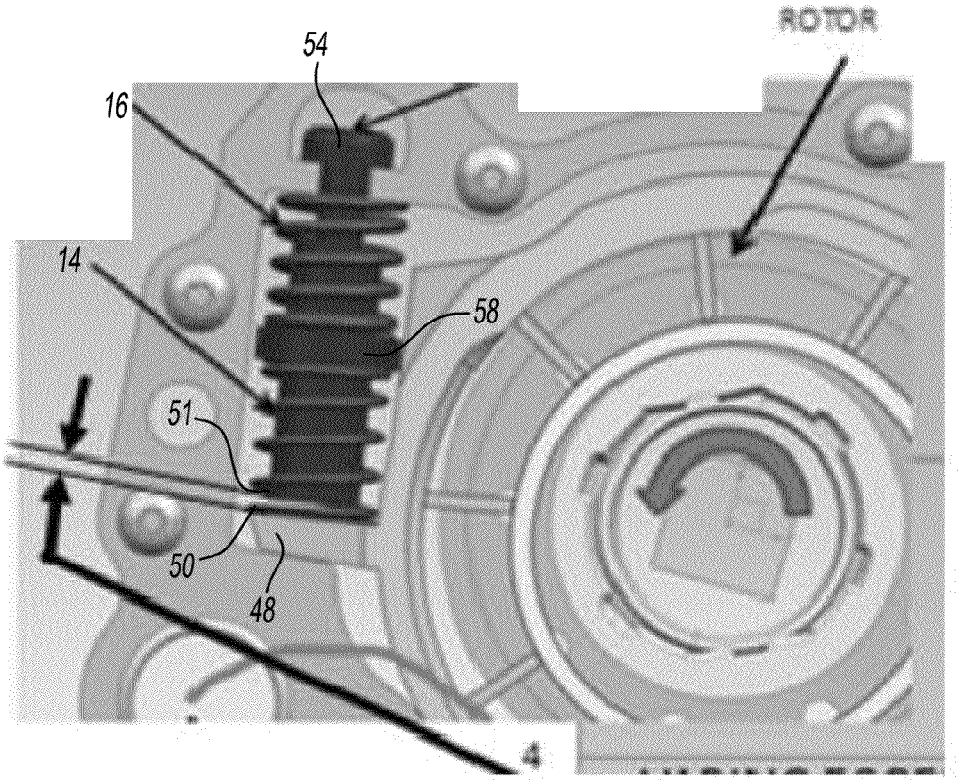

FIG. 7 is a front view of a pump of the present invention in a low pressure environment prior to a first point of regulation particularly highlighting the gap between the pressure regulating spring guide and the slide occurring prior to the first point of regulation.

Figure 8:
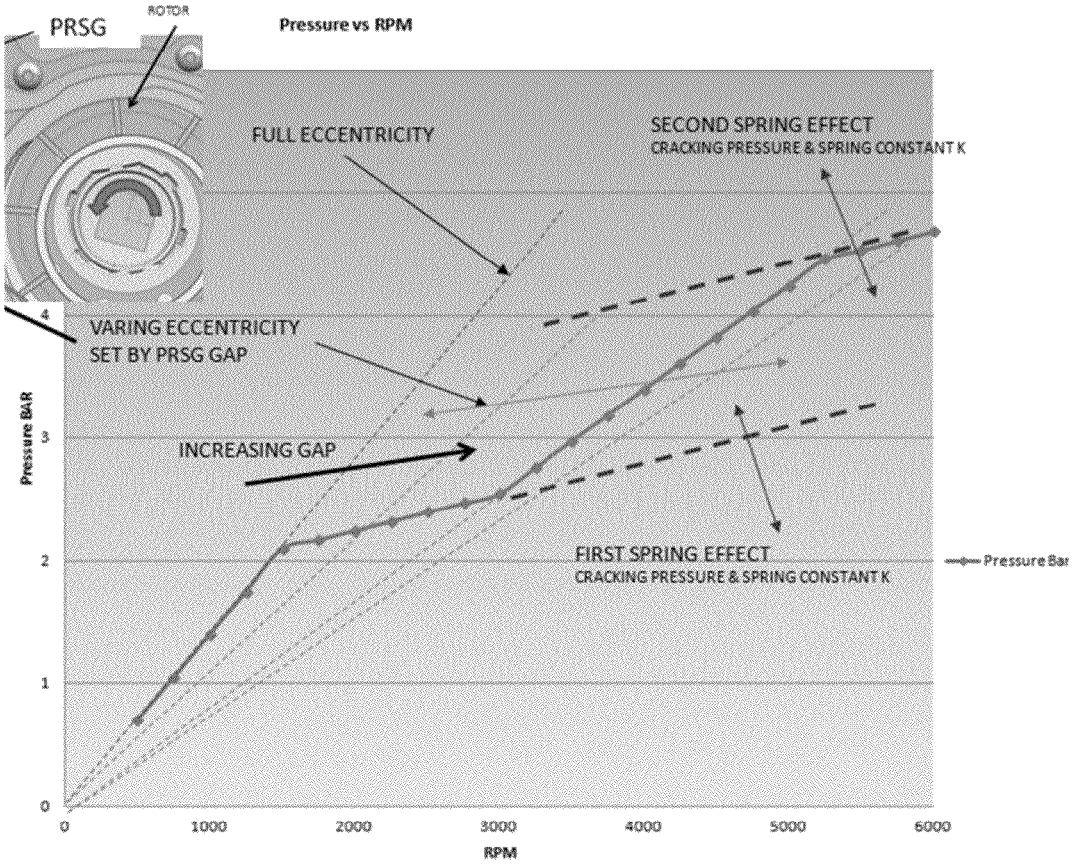

FIG. 8 shows a table of an example of a pump of the present invention highlighting the stages of the present invention and related measurements.

Figure 9A:
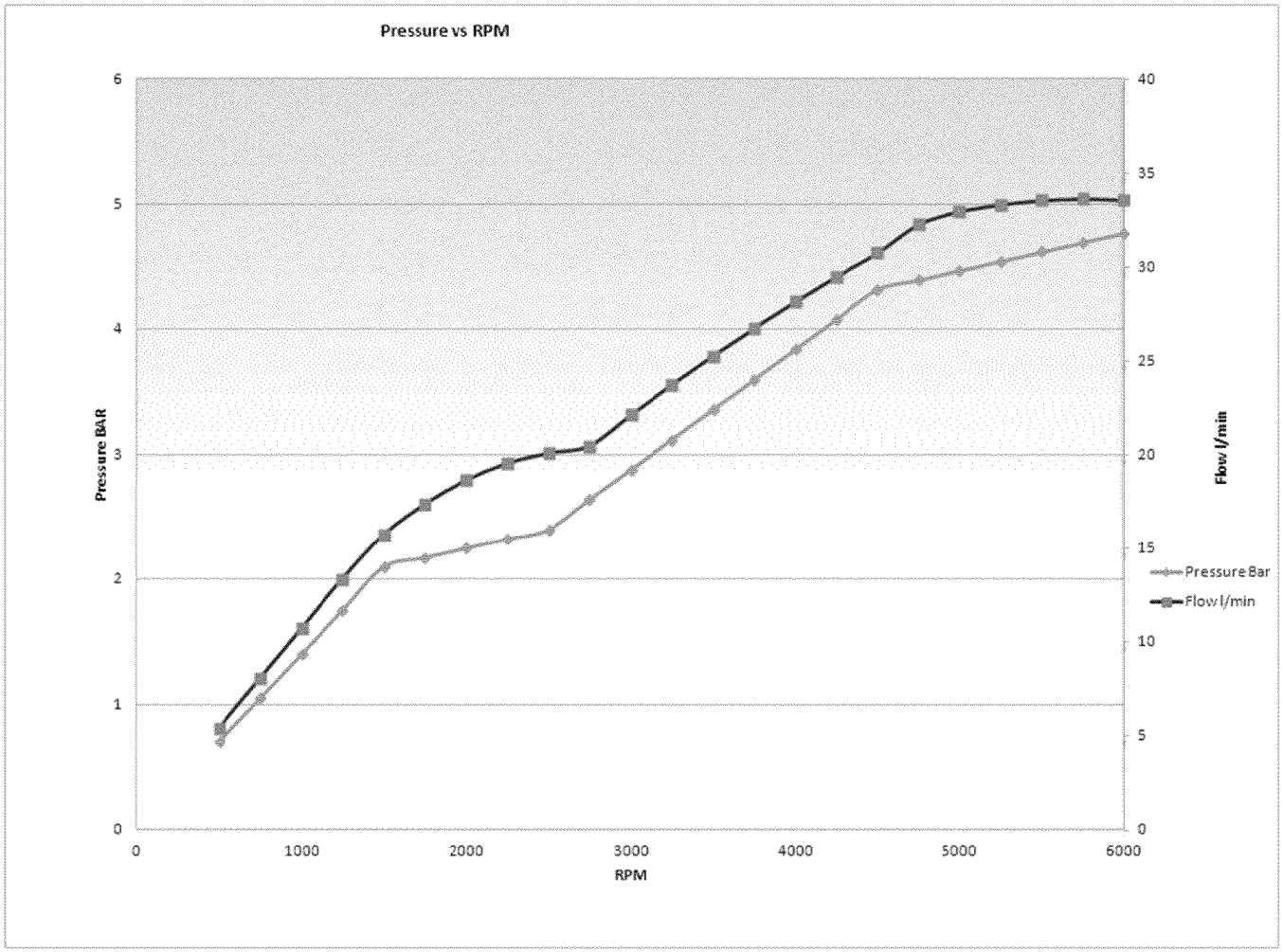
Figure 9B:
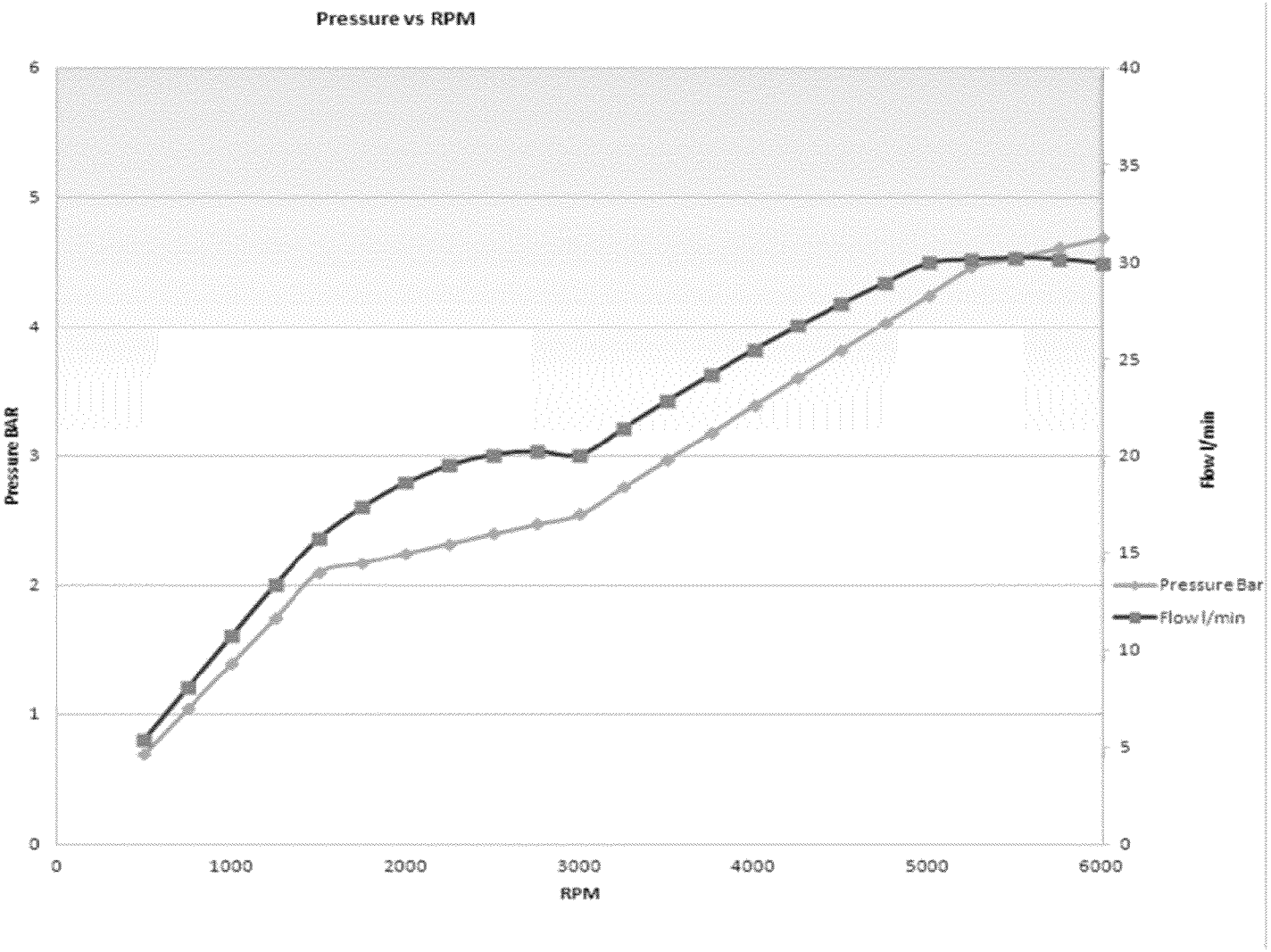

FIG. 9*a* shows a table of an example of a pump of the present invention with a decreased gap between the pressure regulating spring guide and the slide than is shown in FIG. 9*b*.

FIG. 9*b* shows a table of an example of a pump of the present invention with a increased gap between the pressure regulating spring guide and the slide than is shown in FIG. 9*a*.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

The present invention is a multiple stage variable displacement vane pump 10 comprising a pressure regulating spring guide 12. A first spring 14 and a second spring 16 may be controlled by said pressure regulating spring guide. The present invention does not require a solenoid or electronic control. Control of flow and speed of the pump is achieved through operation of the pressure regulating spring guide. The first spring and second spring are operable in relation to one another, but the first spring and the second spring may undertake activities independently of each other. The springs may be positioned inline to each other and in proximity to the pressure regulating spring guide. Rotation of a slide 20 and pressure exerted thereby upon the pressure regulating spring guide may create a first spring regulation stage and a second spring regulation stage.

The spring is utilized in the pump to permit movement of the slide which creates a variation of the eccentricity between the slide and a rotor 22. The slide is attached to, or incorporated in, a cam ring 24 that encircles the rotor, and the slide may include a tab section. When a change in eccentricity occurs, the displacement of the pump is altered. The altered pump displacement causes the flow output of the pump to be at a fixed speed and pressure.

Prior art attempts to add a second stage to a variable displacement vane pump have involved the incorporation of a solenoid in the pump. The solenoid operates to increase the pressure on the slide which further varies the force on the spring. In such prior art pumps the solenoid action is generally controlled by the electronic system of the engine. When a solenoid is operated to be on or off the solenoid shifts the pressure curve either up or down along the speed range of the engine.

Figure 1:
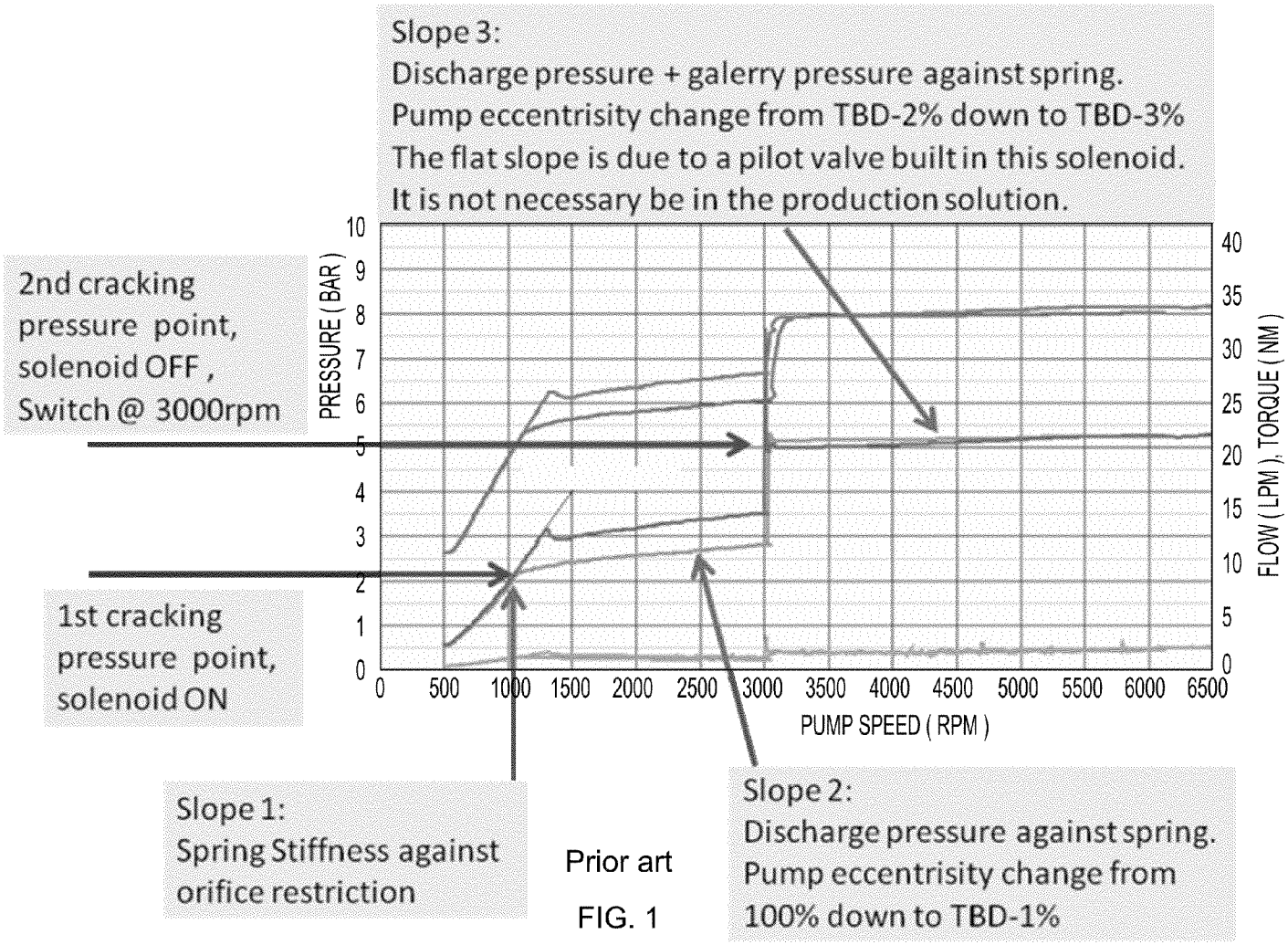
Prior art FIG. 1
FIG. 1 is a table showing typical pressure and revolutions per minute (RPM) curve for a prior art variable displacement vane pump incorporating a solenoid.

As shown in FIG. 1, the prior art variable displacement vane pump incorporating a solenoid has several drawbacks over the prior art. The prior art has a first cracking pressure point when the solenoid is in the on position. The prior art has a second cracking pressure point when the solenoid is in the off position, occurring generally when the switch is at 3000 RPM. The first slope in the table of FIG. 1 occurs during a period when the spring of the prior art has stiffness against orifice restriction. A second slope occurs with discharge pressure against the spring that causes the pump eccentricity to change from 100% to a level that can be less than 1%. A third slope occurs when a combination of discharge pressures and gallery pressure is directed against the spring, at which point the pump eccentricity can change from less than 2% to less than 3%. This slope can be flat due to a pilot valve built into the solenoid incorporated in the pump, however not all solenoids in the prior art include a pilot valve.

The present invention offers a benefit over the prior art in that it does not incorporate a solenoid and further does not require outside control, such as electrical control as may be provided by the engine in some prior art. The present art may incorporate two or more springs and a pressure regulating spring guide operable to create multiple stages. The pressure regulating spring guide may allow the pump to have two pressure curves with relation to the driveshaft speed.

Figure 2:
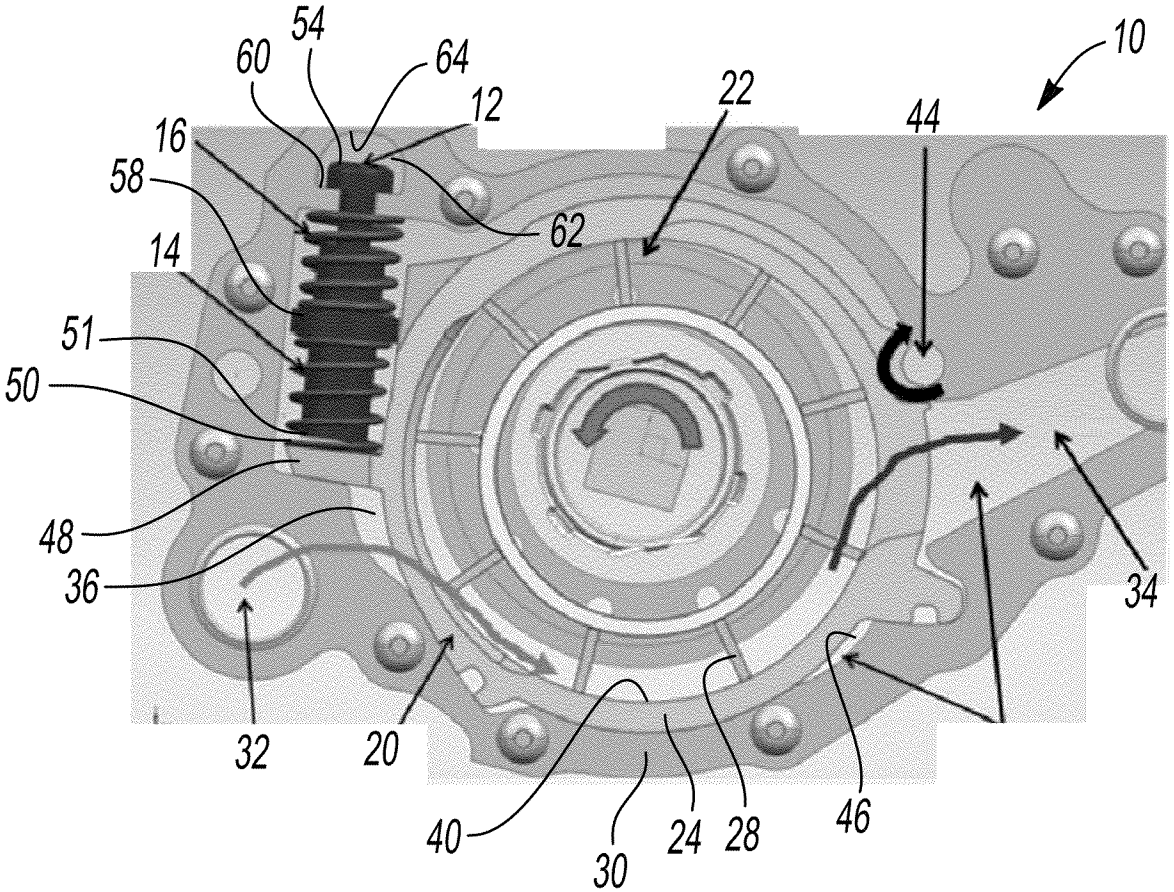
FIG. 2 is a front view of a multiple stage variable displacement vane pump of the present invention.

As shown in FIG. 2, the present invention in one embodiment comprises rotor 22 including a plurality of vanes 28 slidably extending radially from the rotor. The present invention may further comprise a pump housing 30 defining a pump inlet 32, a pump outlet 34 and a rotor chamber 36. The rotor may be received and positioned within the rotor chamber. The rotor chamber may incorporate an inlet port in communication with the pump inlet and through which working fluid is introduced to the rotor. The rotor chamber may further incorporate an outlet port through which working fluid exits the rotor to the pump outlet. The outlet port may be connected to the pump outlet via a passage.

The pump may further comprise cam ring 24 encircling rotor 22. The ends of the vanes of the rotor may engage an inner surface 40 of the cam ring to form variable volume pump chambers between adjacent vanes 28, rotor 22 and cam ring 24. The cam ring may be pivotable within the rotor chamber about a pivot pin 44 to alter the eccentricity of the cam ring with respect to the rotor to change the displacement of the pump. The cam ring has slide section 20 incorporated therein or attached thereto. A regulating chamber 46 is incorporated in the pump for receiving working fluid from the pump outlet. The working fluid applies a regulating force to the cam ring 24.

In embodiments of the present invention, pressure regulating spring guide 12 is received within the rotor chamber 36 and is operable to control two or more springs. The two or more springs may be positioned inline to each other and in proximity to the pressure regulating spring guide. The pressure regulating guide is operable through contact with the slide 20, and in particular a tab 48 formed in the slider.

In one embodiment of the present invention, the coil of first spring 14 positioned near the base of the pressure regulating spring guide, being a coil 50 of first spring 14, may extend below a lower end 51 of the pressure regulating spring guide. As the slide rotates, the tab 48 may come into contact with coil 50 of first spring 14 that extends below the lower end of the pressure regulating spring guide 12 before the slide comes into contact with the pressure regulating spring guide. Thus, compression of first spring 14 may occur prior to the slide rotating sufficiently to be in contact with the pressure regulating spring guide 12.

In one embodiment of the present invention, housing 30 of the present invention may house rotor 22 that is a substantially cylindrical rotor mounted about a central axis of the housing. The housing may incorporate one or more connection means for mounting onto a mounting plate of an internal combustion engine, or other prime mover.

The volume of the pumping chambers varies with rotation of the rotor, which forms a suction section in the volume increasing portion and a discharge section in the volume decreasing portion. As the rotor rotates and moves the pump chambers out of fluid communication with the inlet port the working fluid is pressurized due to changes in the volume of the pump chambers. During operation, a pressure drop that is directly proportional to the flow within the pump, so that when the flow increases, the pressure drop also increases.

In typical usage, variable displacement vane pumps are arranged to have a selected equilibrium operating volume flow, or pressure. This equilibrium operating volume/pressure is usually achieved via a regulating member, such as a spring, which acts to bias the cam ring about the pivot point to a position of maximum eccentricity (i.e.—maximum volumetric displacement). Against the biasing force produced by the spring is a force produced by the working fluid produced by the pump.

In an embodiment of the present invention, as shown in FIG. 2, the pump incorporates first spring 14 and second spring 16. The second spring 16 is located near the top end of the pressure regulating spring guide that includes a flange, and the first spring is located below the second spring and near to the lower end of the pressure regulating spring guide.

The compression of the springs may be controlled by the pressure regulating spring guide. Although, the first spring may begin to compress prior to the slide rotating sufficiently to be in contact with the pressure regulating spring, and therefore the first spring may be initially compressed by the force exerted by the slide upon the coil of the first spring.

The pressure regulating spring guide is positioned in proximity to the springs, such as within the coils of the springs. The first spring and second spring may be positioned to be inline in relation to each other, and this inline position may be maintained by the positioning of the pressure regulating spring guide within the springs, so that a second spring is coiled around the upper portion of the pressure regulating spring guide, and the first spring is coiled around the lower portion of the pressure regulating spring guide. A radially outwardly extending land portion 58 of the pressure regulating spring guide is fixed to and separates the upper and lower portions. First spring 14 and second spring 16 engage land portion 58.

The FIGs. of the present invention show an embodiment of the present invention incorporating two springs, and operable to define two stages. However, a skilled reader will recognize that this embodiment of the present invention is merely provided as an example of the present invention, and that other embodiments of the present invention may incorporate multiple springs and may be operable to define multiple stages.

As shown in FIG. 2, the pump of the present invention incorporates slide 20 that is operable to pivot about the pivot pin 44 when high pressure is exerted on the slide. Rotation of the slide as it pivots may exert force upon any coil of first spring 14 that extends below the lower end of the pressure regulating spring guide 12 as the slide may come into contact with, and thereby exert force upon, the coil of the first spring that is positioned below the lower end of the pressure regulating spring guide thereby causing the first spring to compress. The slide may also pivot and thereby come into contact with the lower edge of the pressure regulating spring guide, so that the force exerted on the pressure regulating spring guide by the slide causes the pressure regulating spring guide to control the compression of the first spring and the second spring.

As force is exerted upon the pressure regulating spring guide it may control the compression of the springs, such that a first spring may compress (and this compression may be an initial compression if in a non-pressure state the coil of the first spring does not extend beyond the lower end of the pressure regulating spring guide, or an increased compression if in a non-pressure state the coil of the first spring extends beyond the lower end of the pressure and the slide therefore comes into contact with the first spring before the slide contacts the pressure regulating spring guide so that the first spring begins to compress when force is exerted upon it by contact with the slide, each positioning of the coil of the first spring is possible in embodiments of the present invention) as a certain amount of force is exerted by the slide upon the pressure regulating spring guide, and the first spring may continue to have increased compression as the slide rotates further and thereby increases the force exerted upon the pressure regulating spring guide. The point when first spring 14 begins to compress may be identified as the first point of regulation.

As the force exerted upon the pressure regulating spring guide continues to increase, the pressure regulating spring guide may control the compression of the second spring so that the second spring begins to compress as a certain amount of force is exerted by the slide upon the pressure regulating spring guide, and the second spring may continue to have increased compression as the slide rotates further and thereby increases the force exerted upon the pressure regulating spring guide. The point when second spring 16 begins to compress may be identified as the second point of regulation.

In one embodiment of the present invention, the first spring may be formed and shaped to be more easily compressed than the second spring, or the first spring may be formed of a material that causes it to be more easily compressed than the second spring. This means that the first spring will compress with less force exerted upon it than is required to compress the second spring.

In embodiments of the present invention the springs may experience some level of compression simultaneously, or the first spring may be fully compressed before the second spring begins to compress. For example, the first spring may be compressed while the second spring is not compressed, and the first and second springs may be compressed simultaneously in accordance with the rotation of the slide. In all embodiments of the present invention, the second spring will not be compressed when the first spring is not compressed. The compression of each spring may be related to the compression, or lack of compression, of the other spring, as may be controlled by the pressure regulating spring guide or controlled by contact between the slide and the first spring before the slide contacts the pressure regulating spring guide in embodiments of the present invention.

The springs, controlled by the pressure regulating spring guide, may exert pressure, for example, such as high pressure, upon the slide, and thereby cause the slide to pivot around the pivot pin.

The pump may include pump inlet 32 whereby fluid may be introduced to the pump and may flow into the pump. The rotor 22 of the pump 10 may be operable to rotate, for example, such as in a counter-clockwise direction, in accordance with movement of the slide 20. As the rotor turns the fluid may be pumped through the pump. The fluid may be dispensed from the pump through pump outlet 34.

Figure 3:
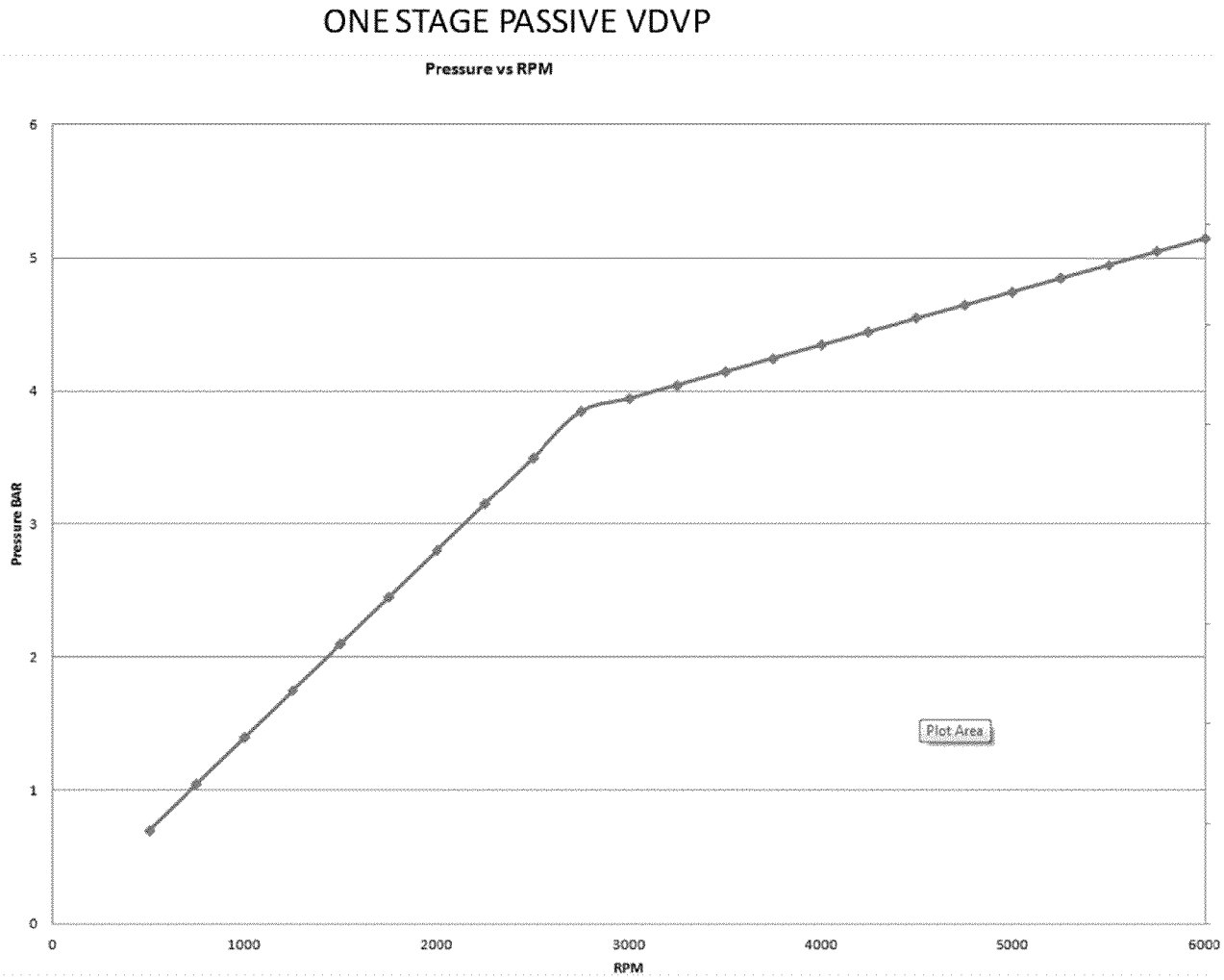
FIG. 3 PRIOR ART
FIG. 3 is a table showing typical prior art one stage passive variable displacement vane pump trajectory.
Figure 4:
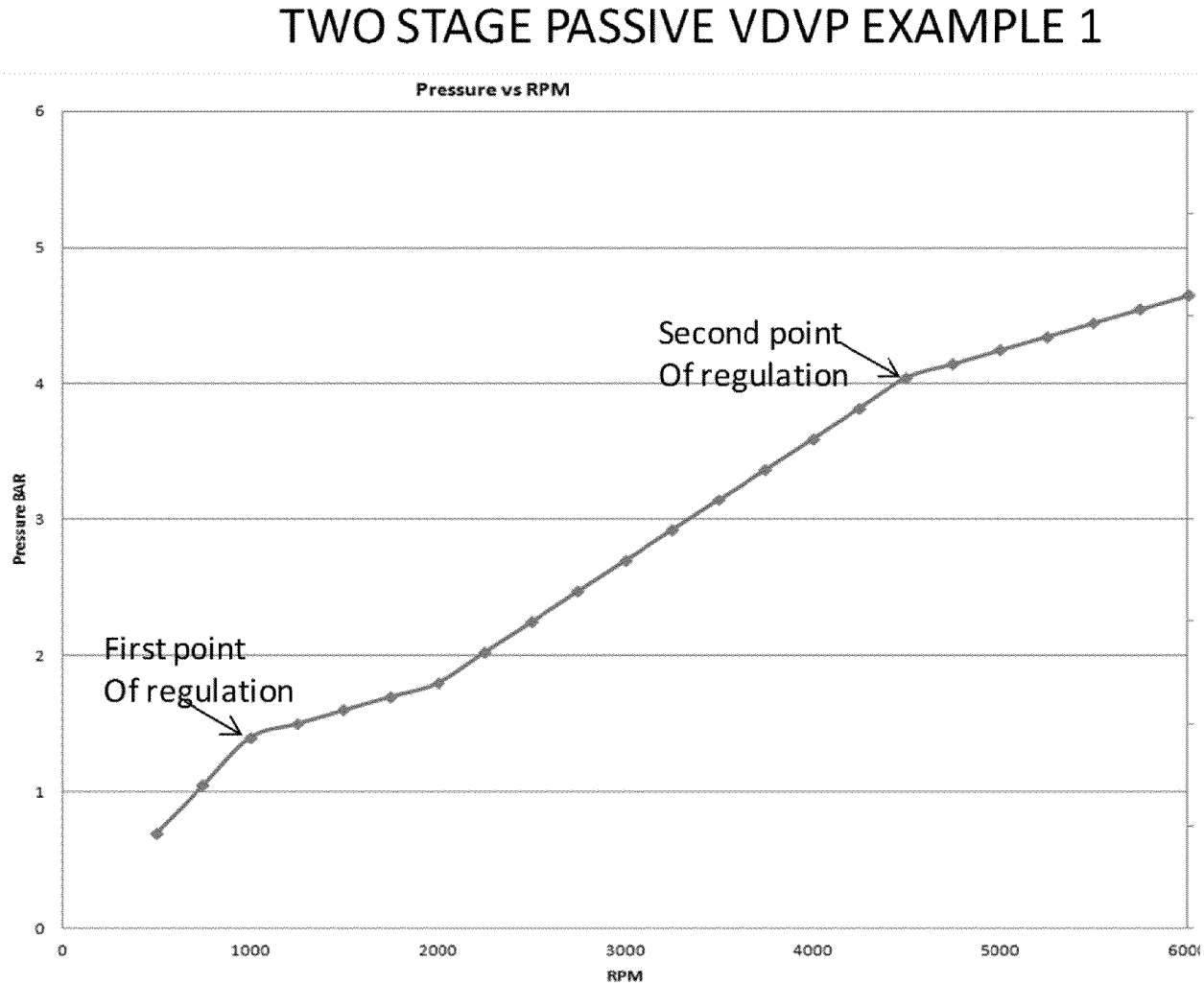
FIG. 4 is a table showing an example trajectory of a two stage passive variable displacement vane pump of the present invention that incorporates a first point of regulation and a second point of regulation.

As shown in FIG. 3, the initial speed range of a prior art one stage passive variable displacement vane pump may incorporate a spring cracking pressure point at a mid-way point. As shown in FIG. 4, an embodiment of the present invention that is a two stage passive variable displacement vane pump may produce a speed range that includes a first point regulation that occurs when the first spring begins to be compressed, and a second point of regulation that occurs when the second spring begins to be compressed.

As shown in FIG. 5*a*, first spring 14 and second spring 16 may be loosely coiled when low pressure exists in the pump. The slide 20 may rotate around an axis defined by the central axis of the housing. As the slide rotates pressure within the pump may increase or decrease. For example, as the slide rotates in a clockwise direction the pressure may increase, and the slide rotates in a counterclockwise direction the pressure may decrease. Rotation of the slide may be caused by pressure in the pump, so that as the pressure increases the slide rotates clockwise in response to the increased pressure, and as the pressure decreases the slide rotates counterclockwise in response to the decreased pressure. A skilled reader will recognize that other directions of rotation may be possible in embodiments of the present invention. The slide may be positioned to surround or otherwise encompass the rotor that is also positioned to rotate around an axis defined by the central axis of the housing.

The flange 54 of the top end of the pressure regulating spring guide 12 may be positioned to be in contact with a lower inner wall 60 of a notch 62 within the housing wherein the top end of the pressure regulating spring guide resides, so that empty space exists between the top edge of the pressure regulating spring guide and an upper inner wall 64 of the notch area. As the pressure increases in the pump the force of such pressure may cause the slide to rotate to the point whereby the slide comes into contact with the base of the pressure regulating spring guide. Tab 48 incorporated in the slide that is positioned below the base of the first spring and the base of the pressure regulating spring guide may move to contact the base of the pressure regulating spring guide as the slide rotates. As described herein, in embodiments of the present invention, the slide may contact the first spring before it contacts the base of the pressure regulating spring guide if the coil of the first spring is positioned below the base of the pressure regulating spring guide when low pressure exists in the pump.

In one embodiment of the present invention, as pressure increases from a low pressure state in the pump, contact may occur between the slide, and specifically the tab in the slide and the pressure regulating spring guide as the slide rotates.

In another embodiment of the present invention, as pressure increases from a low pressure state in the pump, contact may occur between the slide, and specifically the tab 48 in the slide 20 and the coil 50 of the first spring 14 that is positioned below the lower end of the pressure regulating spring guide as the slide rotates. As pressure increases in the pump, the slide will continue to rotate and the slide, and specifically the tab in the slide will contact the pressure regulating spring guide.

In a low pressure environment in the pump, neither the first spring nor the second spring are compressed. As the slide rotates to make contact with either the pressure regulating spring guide or the coil of the first spring positioned below the lower edge of the pressure regulating spring guide, the first spring will begin to compress. The point when the first spring begins to compress, due to direct contact with the slide or due to contact between the slide and the pressure regulating spring guide, is a first point of regulation, as indicated in FIG. 6*a*.

In an embodiment of the present invention wherein the slide makes contact with the pressure regulating spring guide as its first contact as it rotates (and the coil of the first spring is not positioned below the lower end of the pressure regulating spring guide when the pump is in a low pressure state), at the first point of regulation the slide stops on the pressure regulating spring guide. As the slide continues to rotate, tab 48 of the slide exerts pressure on the pressure regulating spring guide 12 and the first spring compresses in proportion to the increase of pressure upon the pressure regulating spring guide produced as the slide rotates. The pressure in the pump increases beyond low pressure, moving towards high pressure, in proportion to the rotation of the slide.

As shown in FIG. 5*b*, as the slide rotates, the tab 48 of the slide may move so as to no longer be in contact with the pump housing, thereby creating a space between the tab and the pump housing. The flange 54 on top end of the pressure regulating spring guide may also be moved as the slide rotates, so that the flange is no longer in contact with the lower inner wall 60 of the notch 62 in the housing and there is space between the flange and the lower inner wall of the notch.

This movement of the slide is shown in FIG. 6*b* as occurring between a first point of regulation and a second point of regulation. During the period between a first point of regulation and second point of regulation a fixed eccentricity is achieved in the pump. Generally, between the first point of regulation and the second point of regulation, the first spring starts to compress in accordance with force exerted by the slide on the pressure regulating spring guide and thereby upon the first spring. A constant eccentricity and/or fixed pump displacement is achieved by the movement of the slide. The second spring may remain uncompressed, or slightly compressed, between the first point of regulation and the second point of regulation, in accordance with the force exerted upon the pressure regulating spring guide by the slide.

As the slide continues to rotate, and rotates beyond the second point of regulation, the second spring will be compressed in proportion to the rotation of the slide. As shown in FIG. 5*c* the space between the tab of the slide and the housing increases as the slide rotates. The space between the lower inner wall of the notch and flange of the top of the pressure regulating spring guide is also increased. After the second point of regulation the pressure is regulated by the second spring.

The force exerted by the slide upon the pressure regulating spring guide in one embodiment of the present invention, or force exerted by the slide upon the coil of the first spring in another embodiment of the present invention, causes the first spring to initially compress. As the slide continues to rotate the first spring will continue to be increasingly compressed. The second spring may begin to compress before the first spring is fully compressed as the pressure increases and force upon the pressure regulating spring guide increases. The springs will compress in proportion to the rotation of the slide and the level of compression of one or the springs may differ compared to the other spring at any point in time. For example, the first spring may be more compressed than the second spring immediately following the second point of regulation.

After the second point of regulation, the pressure is high enough to create a high enough force to compress the second spring. As the slide rotates the eccentricity decreases, so that the pump displacement decreases. At higher speeds the pump outlet pressure is regulated by the second spring. The speed range past the second point of regulation, whereby pressure is regulated by the second spring, is shown in FIG. 6*c*.

In an embodiment of the present invention, the first spring, the second spring and the pressure regulating spring guide each individually, separately and distinctly affect the pressure profile of the pump. The first spring may be operable to set the minimum cracking pressure to limit the pressure and flow. The second spring may be operable to set the maximum pressure and flow. The pressure regulating spring guide may be operable to set the eccentricity of the pump to match the engine flow and the pressure requirements from the low to high RPM operating range. Whereby, the gap between the pressure regulating spring guide and the housing may set varying eccentricity levels. For example, a specific gap, or space, between the flange of the top of the pressure regulating spring guide and the lower wall of the notch of the housing, and/or a specific gap, or space, between the lower edge of the pressure regulating spring guide and the tab of the slide (as shown in FIG. 7), may achieve a specific eccentricity level.

The table of FIG. 8 shows the effects of pressure and RPM in the pump of the present invention, including the effect of increasing the gap between the pressure regulating spring guide and the slide. The table specifically shows an example of the pressure trajectory in the pump of the present invention. An increasing gap creates an incline in pressure and RPMs. A first spring effect occurs at a point of cracking pressure affecting the first spring, when the spring constant K is achieved in relation to the first spring. A second spring effect occurs at a point of cracking pressure affecting the second spring, when the spring constant K is achieved in relation to the second spring. The table further shows a projected full eccentricity trajectory, to indicate that the present invention does not achieve full eccentricity, as well as an indication of the varying eccentricity achieved by setting the pressure regulating spring guide gap.

As shown in FIGS. 9*a* and 9*b*, examples of the pressure trajectory and flow trajectories in embodiments of the present invention, will alter as the gap between the lower end of the pressure regulating spring guide and the slide is increased. In FIG. 9*a*, showing the effects of a smaller gap, the flow trajectory achieves increased rates than the flow trajectory of FIG. 9*b* showing an increased gap. Thus increasing the gap can cause the flow to be lessened. The first and second regulation points may also differ between an embodiment of the invention wherein there is a decreased gap (as shown in FIG. 9*a*) as opposed to an embodiment of the invention wherein there is an increased gap (as shown in FIG. 9*b*). The present invention may therefore achieve various pressure vs. speed curves in accordance with the gap that is set in an embodiment of the invention, and in applications of embodiments of the invention. In this manner the present invention may be utilized to match requirements of specific engines.

It will be appreciated by those skilled in the art that other variations of the embodiments described herein may also be practiced without departing from the scope of the invention. For example, additional regulation points and springs may be incorporated in the present invention to achieve additional stages of the pump of the present invention. Other modifications are therefore possible.

What is claimed is:

1. A variable displacement vane pump comprising:

a housing;

a rotor positioned within the housing;

vanes slidably coupled to the rotor;

a pivotable cam ring having an inner surface engaged by the vanes, wherein rotation of the cam ring varies an eccentricity of the cam ring relative to the rotor to vary the displacement of the pump;

a pressure regulating spring guide urging the cam ring toward a position of maximum eccentricity, the pressure regulating spring guide including first and second springs engaging a slidable shaft, the first spring engaging the cam ring and the second spring engaging the housing; and a pressure chamber in receipt of pressurized fluid output by the pump to apply a force urging the cam ring toward a position of minimum eccentricity, wherein the pressure regulating spring guide includes a land portion separating and being engaged by the first and second springs.

2. The variable displacement vane pump of claim 1, wherein the pressure regulating spring guide includes a flange fixed at an end of the shaft, the flange being positioned within a pocket of the housing to limit the range of axial travel of the shaft.

3. The variable displacement vane pump of claim 2, wherein the second spring biases the flange into engagement with the housing when the cam ring is at the position of maximum eccentricity.

4. A variable displacement vane pump comprising:

a housing;

a rotor positioned within the housing;

vanes slidably coupled to the rotor;

a pivotable cam ring having an inner surface engaged by the vanes, wherein rotation of the cam ring varies an eccentricity of the cam ring relative to the rotor to vary the displacement of the pump;

a pressure regulating spring guide urging the cam ring toward a position of maximum eccentricity, the pressure regulating spring guide including first and second springs engaging a slidable shaft, the first spring engaging the cam ring and the second spring engaging the housing; and a pressure chamber in receipt of pressurized fluid output by the pump to apply a force urging the cam ring toward a position of minimum eccentricity, wherein the first spring overhangs an end of the shaft while engaging the cam ring when the cam ring is in the position of maximum eccentricity.

5. The variable displacement vane pump of claim 4, wherein the first and second springs are coaxially aligned with one another and axially spaced apart from each other.

6. The variable displacement vane pump of claim 5, wherein the shaft extends through the first and second springs.

7. The variable displacement vane pump of claim 4, further including first and second seals fixed for rotation with the cam ring and engaging the housing to at least partially define the pressure chamber.

8. A variable displacement vane pump comprising:

a housing;

a rotor positioned within the housing;

vanes slidably coupled to the rotor;

a pivotable cam ring having an inner surface engaged by the vanes, wherein rotation of the cam ring varies an eccentricity of the cam ring relative to the rotor to vary the displacement of the pump;

a pressure regulating spring guide urging the cam ring toward a position of maximum eccentricity, the pressure regulating spring guide including first and second springs and a slidable shaft, the slidable shaft including a flange biased into contact with the housing by the second spring when the cam ring is at the position of maximum eccentricity, the first spring engaging the cam ring and the second spring engaging the housing; and a pressure chamber in receipt of pressurized fluid output by the pump to apply a force urging the cam ring toward a position of minimum eccentricity, wherein the flange is disengaged from contact with the housing when the cam ring is urged toward the position of minimum eccentricity.

9. The variable displacement vane pump of claim 8, wherein the first spring overhangs an end of the shaft while engaging the cam ring when the cam ring is in the position of maximum eccentricity.

10. The variable displacement vane pump of claim 8, wherein the first and second springs are coaxially aligned with one another.

11. The variable displacement vane pump of claim 10, wherein the shaft extends through the first and second springs.

12. The variable displacement vane pump of claim 8, further including first and second seals fixed for rotation with the cam ring and engaging the housing to at least partially define the pressure chamber.

13. The variable displacement vane pump of claim 8, wherein the first spring includes a first spring rate different than a second spring rate of the second spring.

14. The variable displacement vane pump of claim 8, wherein the second spring is preloaded in compression between the housing and the shaft when the cam ring is in the position of maximum eccentricity.

15. The variable displacement vane pump of claim 8, wherein the flange is positioned at an end of the shaft.

* * * * *